US006302347B1

(12) United States Patent
Amirault

(10) Patent No.: US 6,302,347 B1
(45) Date of Patent: Oct. 16, 2001

(54) SPRING LOADED CORD HOLDER

(76) Inventor: Gerald A. Amirault, 693 Portsmouth Avenue, Kingston, ON (CA), K7M 1W4

( * ) Notice: Subject to any disclaimer, the term of this patent is extended or adjusted under 35 U.S.C. 154(b) by 0 days.

(21) Appl. No.: 09/665,273

(22) Filed: Sep. 19, 2000

(51) Int. Cl.[7] ..... B65H 75/38

(52) U.S. Cl. ..... 242/405.2; 242/388.1; 242/404.1; 242/407; 242/588.2

(58) Field of Search ..... 242/405.1, 405.2, 242/404, 404.1, 404.2, 404.3, 400.1, 407, 388, 388.1, 388.5, 388.6, 398, 588, 588.2, 129, 580, 397, 607.1, 580.1; 191/12 R, 12.2 R; 206/409, 702

(56) References Cited

U.S. PATENT DOCUMENTS

| | | | | |
|---|---|---|---|---|
| D. 337,718 | | 7/1993 | Donaldson | D8/358 |
| D. 344,012 | | 2/1994 | Aoki | D8/356 |
| 3,290,453 | * | 12/1966 | Jensen . | |
| 3,901,458 | * | 8/1975 | Kuncz, Jr. . | |
| 4,261,529 | * | 4/1981 | Sandberg et al. . | |
| 4,277,035 | * | 7/1981 | Gaski . | |
| 4,497,457 | | 2/1985 | Harvey . | |
| 4,577,809 | | 3/1986 | Auer . | |
| 4,586,675 | * | 5/1986 | Brown . | |
| 4,872,622 | | 10/1989 | Mansfield . | |
| 4,991,788 | | 2/1991 | Pattison . | |
| 5,064,067 | | 11/1991 | McAllister | 206/420 |
| 5,145,122 | * | 9/1992 | Poister . | |
| 5,344,093 | | 9/1994 | Cohen | 242/407 |
| 5,961,062 | | 10/1999 | Beihl | 242/400.1 |
| 5,992,787 | | 11/1999 | Burke | 242/388.1 |
| 6,003,803 | | 12/1999 | Knapp | 242/388 |

* cited by examiner

*Primary Examiner*—William A. Rivera
(74) *Attorney, Agent, or Firm*—Richard J. Hicks

(57) ABSTRACT

A holder for storing and dispensing an elongated flexible member, such as a rope, hose or electrical extension cord. A planar elongated handle member has a pair of planar parallel cross members, around which the flexible member is stored, extending perpendicularly therefrom and intermediate the ends thereof. Each cross member has a spring loaded end piece selectively pivotally movable between a closed position in which the flexible member is retained on the holder and an open position, perpendicular to the closed position, in which the flexible member can be rapidly removed from the holder.

6 Claims, 4 Drawing Sheets

SPRING LOADED CORD HOLDER

FIELD OF INVENTION

This invention relates to a device for storing ropes, electrical cords, hoses and other elongated flexible members. More particularly this invention relates to a storage device having spring loaded arms from which the stored flexible member can be easily removed after winding thereon.

BACKGROUND OF INVENTION AND PRIOR ART

The storage and transportation of long flexible members, such as garden hoses, marine throwing lines, electrical extension cords and water ski ropes has, over the years, been an ongoing problem and there have been many attempts to provide adequate storage reels and the like. Some of these reels work quite well for such things as garden hose but are not suitable for use with electrical cords or ropes, and particularly with heaving lines and the like where it is necessary to uncoil the rope as quickly as possible. Attempts have been made to solve the problem of rapid uncoiling and attention is directed to U.S. Pat. No. 4,991,788 issued Feb. 12, 1991 to Pattison. This patent describes a foldable spool, sold under the tradename "Rope Tote", comprising first and second elongated arms, each having a tine at each end, and pivotally interconnected to each other intermediate their respective ends, so as to provide a fork at each end about which a cord can be wound. The wound coil can be removed by pivoting one arm relative to the other so as to separate the tines and open the forks. The arms are releasably held in the closed position by a protrusion at one end of each arm which fits into a corresponding depression at the other end of the complementary arm. If, however, the cord is wound tightly over the forks, thus forcing the arms hard against each other, it is often very difficult to force the arms open as the protrusions may be locked solidly in their respective depressions and quick uncoiling is not possible. Furthermore, the storage capacity of the forks is somewhat limited.

OBJECT OF INVENTION

There is, therefore, a need for an improved cord holder which has an improved capacity and from which it is easy to uncoil the cord no matter how tightly it may have been wound onto the holder.

BRIEF DESCRIPTION OF INVENTION

By one aspect of this invention there is provided a holder for storing and dispensing an elongated flexible member, comprising: an elongated planar handle member having a pair of substantially parallel spaced apart transverse support arms projecting from one side and intermediate the ends thereof; each said support arm having a retaining arm pivotally mounted at the free end thereof for planar movement between an open position in longitudinal alignment with its respective said support arm and a closed position perpendicular to said respective said support arm so as to provide retainers for a said flexible member wound onto said support arms.

DETAILED DESCRIPTION OF PREFERRED EMBODIMENT

Figure 1:
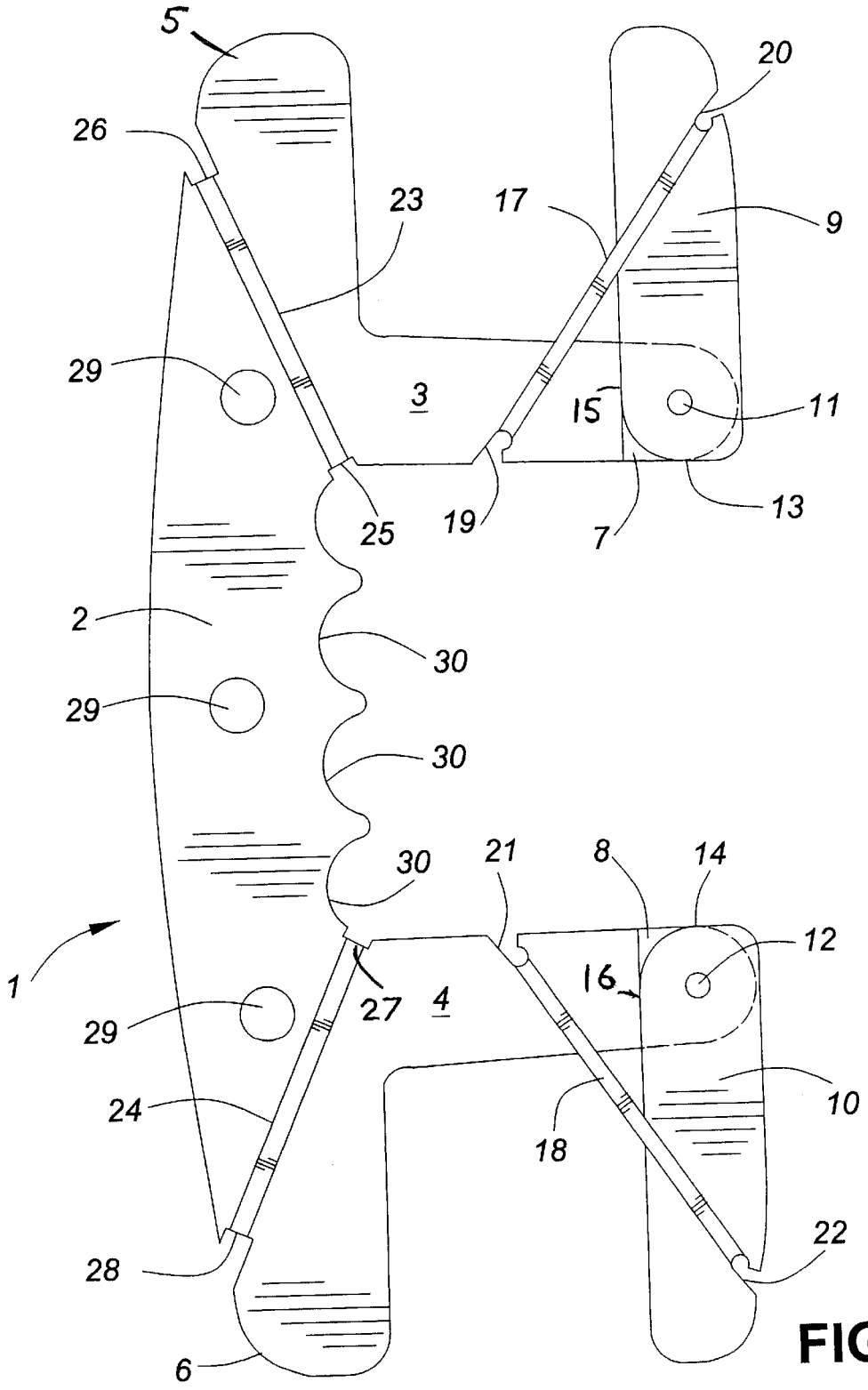
FIG. 1 is a plan view of a cord holder according to one embodiment of the present invention, in the closed position.
Figure 2:
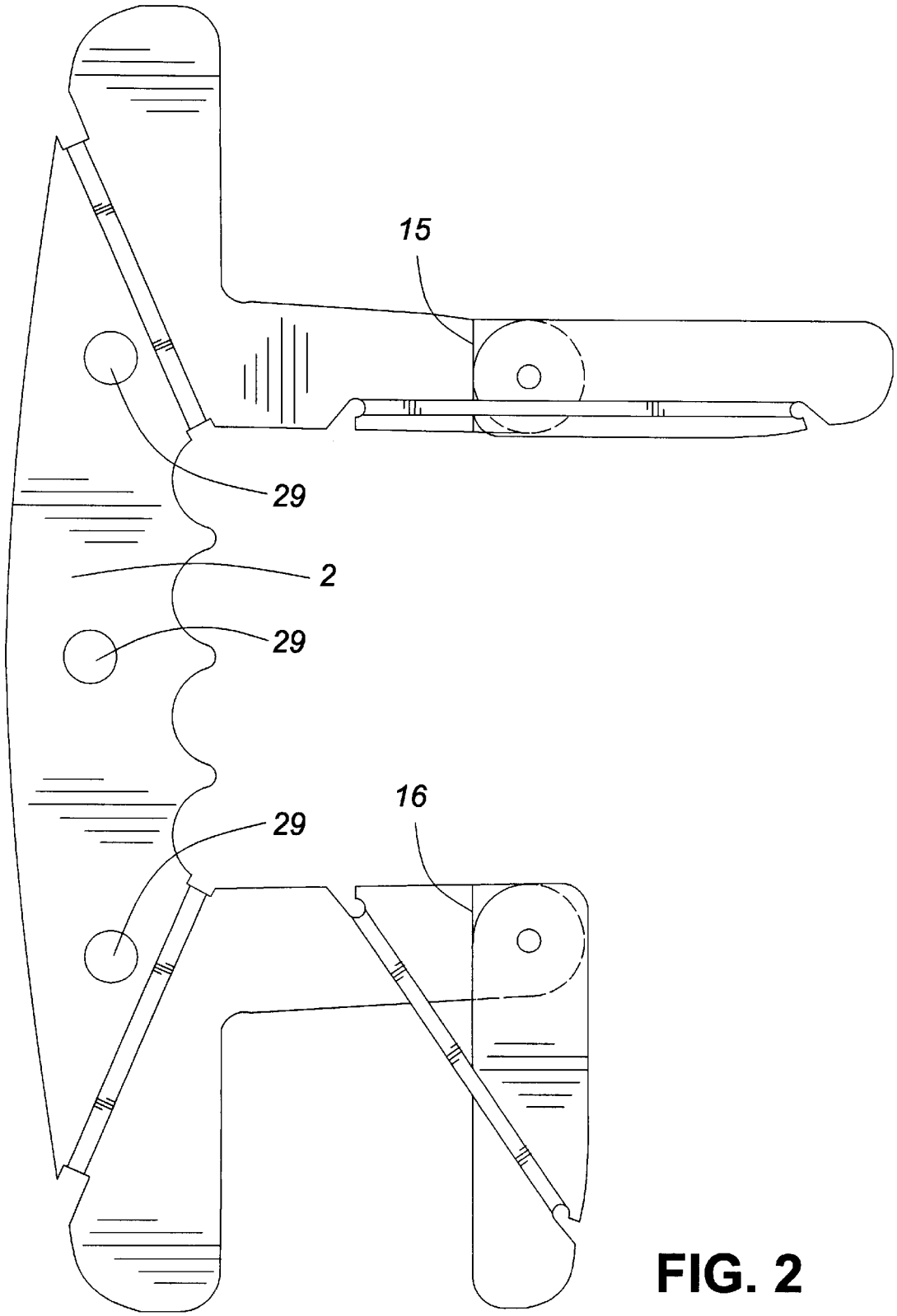
FIG. 2 is a plan view of the embodiment of FIG. 1, in th e open position.

In FIG. 1 there is shown a cord holder of the present invention, comprising a planar H-shaped member 1 generally, but not necessarily, fabricated from a thermoplastics material such as nylon, or high density polyethylene or the like, or from wood or a light metal such as aluminum. The planar H-shaped member 1 comprises an elongated handle portion 2 having cord support arms 3,4 projecting perpendicularly therefrom, equally spaced from the ends 5,6 thereof. Adjacent the free ends 7,8 of arms 3,4 respectively arms 9, 10 are pivotally mounted thereon by pivot pins 11, 12 for movement between a closed position perpendicular to their respective arms 3,4 (FIG. 1) and a one-arm open position (as seen in FIG. 2) extending longitudinally therefrom. Arms 9, 10 are each provided with a stop face 13, 14 which in open position abuts the end faces 15, 16 of the respective arms 3,4 so as to prevent movement beyond the longitudinal extension. Arms 9, 10 are resiliently and selectively held in either the closed position shown in FIG. 1 or the open position shown in FIG. 2 by means of a resilient tension means, which may comprise springs, spring loaded pins or detents 33 (FIG. 4) or other conventional tension means. In the preferred embodiment shown in FIGS. 1 and 2, rubber tension or elastic bands 17, 18 are secured in slots 19, 20 and 21, 22 respectively in arms 3,9 and 4,10 respectively. Preferably, but not essentially, spare rubber bands 23, 24 can be stored in slots 25, 26 and 27, 28 respectively in arms 5,6. Bands 23, 24 have a secondary function in that they may be used to releasably secure the end of a cord being wound onto the holder 1. Also optionally and not essentially, handle 2 may be provided with one or more holes 29 which can be used to suspend the holder from a nail or hook when in storage, or to tie the bitter end of the cord or cable to the holder. Handle 2 may also, optionally, be provided with one or with a plurality of finger grip recesses 30 to facilitate easy handling of the holder 1.

Figure 3:
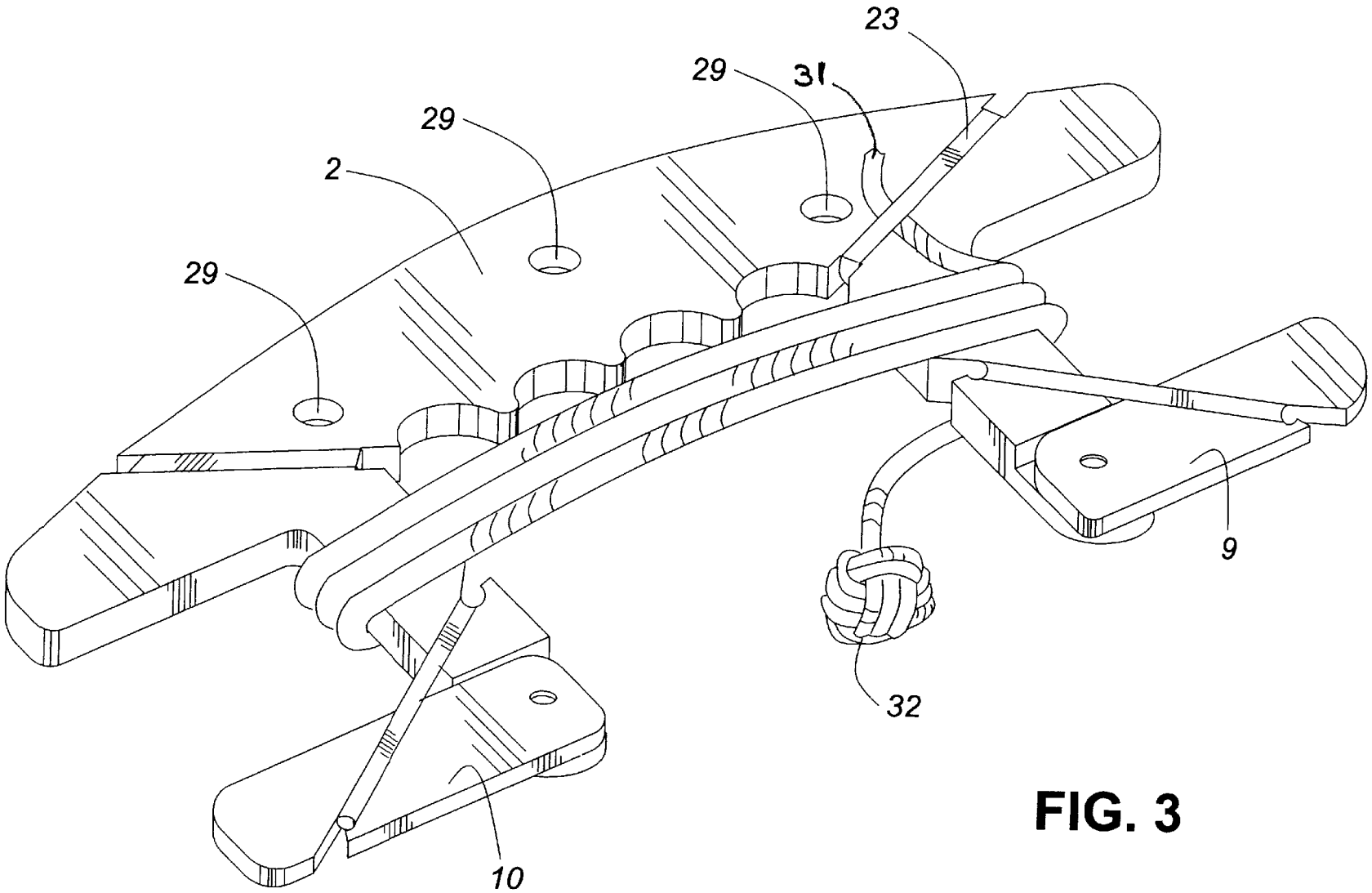
FIG. 3 is a perspective view of the embodiment of FIG. 1, in closed position, showing a cord wound thereon.
Figure 4:
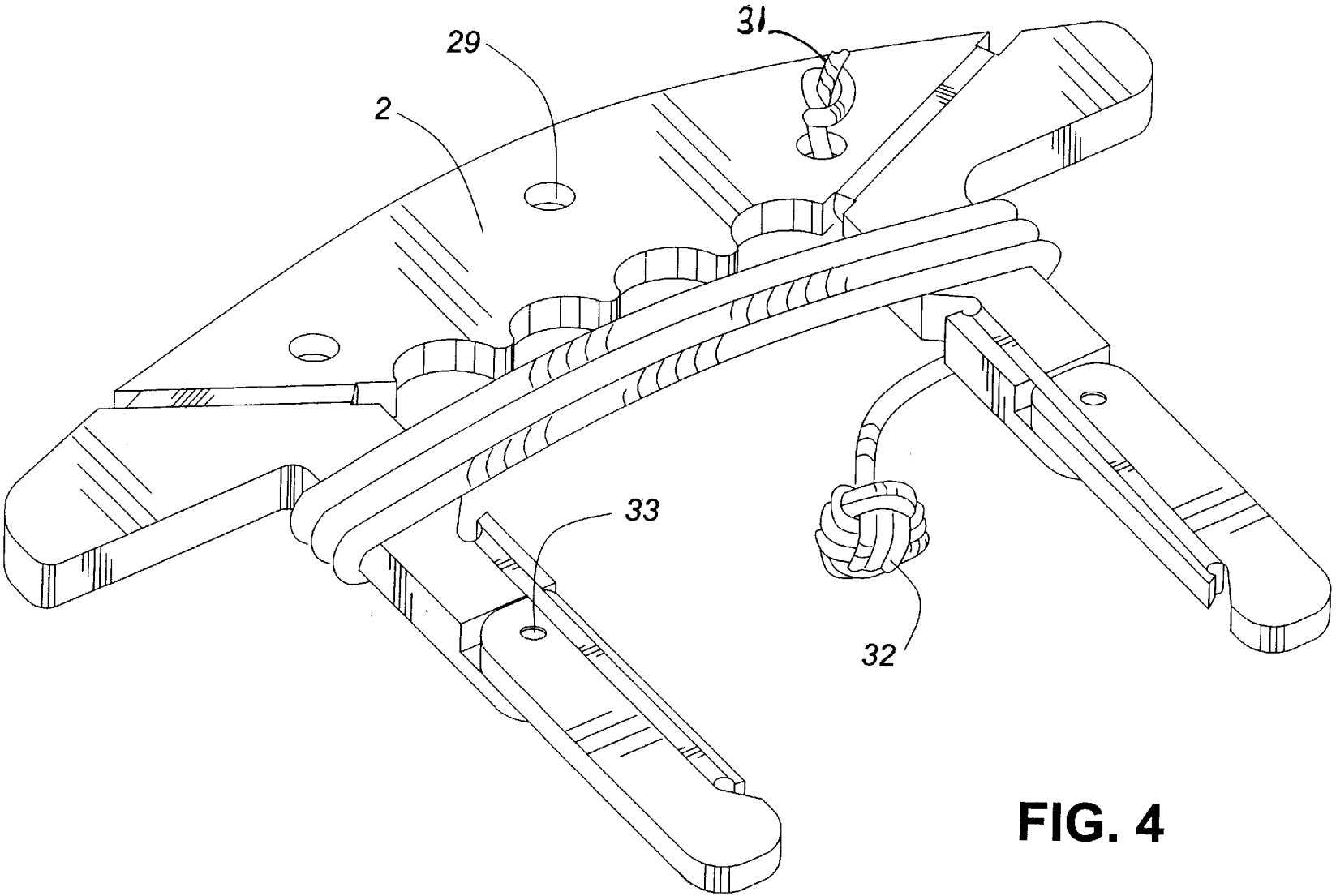
FIG. 4 is a perspective view of the embodiment of FIG. 1, in open position, with a cord mounted thereon for easy removal therefrom.

In operation, the bitter end of a cord or cable 31 is secured to handle 2 via one of the holes 29 (FIG. 4) or by inserting the bitter end under spare band 23 (FIG. 3) with arms 9,10 in the closed position. The cord 31 is then wound loosely over the arms 3,4 as seen in FIG. 3. To unwind the cord 31, the arms 9, 10 are quickly snapped to the open position as shown in FIGS. 2 and 4 and the cord can then easily slide off arms 3,4. If the holder is being used to carry a marine heaving line or the like, it will be appreciated that if a float or monkey's fist or the like 32 is attached to the free end of the line, the user can grip the holder 1 by handle 2 and, using an overarm throwing action, or an underarm twirling and throwing action while holding the rope a few feet from the float with the other hand, simply throw the float 32 in the desired direction and the cord 31 will follow smoothly and without risk of kinking or knotting up. A float delivered in this way gains leverage and can be directed further and with more precision than merely throwing a float freehand. Alternatively, the handle could be mounted on the stern rail of a vessel and actuated in an emergency by simply flicking the arms 9, 10 to the open position and allowing the vessel's forward speed draw the cord 31 off arms 3, 4.

What is claimed is:

1. A holder for storing and dispensing an elongated flexible member, comprising: an elongated planar handle member having a pair of substantially parallel spaced apart planar transverse support arms projecting from one side and intermediate the ends thereof; each said support arm having a retaining arm pivotally mounted at the free end thereof for planar movement between an open position in longitudinal alignment with its respective said support arm and a closed position perpendicular to said respective said support arm so as to provide retainers for a said flexible member wound onto said support arms, and including tension means mounted between each said support arm and its respective retaining arm so as to resiliently retain said retaining arm in a selected one of said open and closed positions.

2. A holder as claimed in claim 1 wherein said tension means comprises an elastic band.

3. A holder as claimed in claim 1 wherein said tension means comprises spring loaded detent means.

4. A holder as claimed in claim 1 including means to releasably secure said flexible member to said holder.

5. A holder as claimed in claim 1 including finger grips in said handle.

6. A holder as claimed in claim 1 including means in said handle to suspend said holder.

* * * * *